US009677790B2

(12) United States Patent
Sakai et al.

(10) Patent No.: US 9,677,790 B2
(45) Date of Patent: Jun. 13, 2017

(54) MULTI-ROOM AIR-CONDITIONING APPARATUS

(75) Inventors: Mizuo Sakai, Chiyoda-ku (JP); Soshi Ikeda, Chiyoda-ku (JP); Hiroaki Nakamune, Chiyoda-ku (JP); Susumu Yoshimura, Chiyoda-ku (JP); Naofumi Takenaka, Chiyoda-ku (JP); Hiroki Okazawa, Chiyoda-ku (JP); Keisuke Hokazono, Chiyoda-ku (JP); Osamu Morimoto, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 84 days.

(21) Appl. No.: 14/396,236

(22) PCT Filed: May 14, 2012

(86) PCT No.: PCT/JP2012/003135

§ 371 (c)(1),
(2), (4) Date: Oct. 22, 2014

(87) PCT Pub. No.: WO2013/171783

PCT Pub. Date: Nov. 21, 2013

(65) Prior Publication Data

US 2015/0135756 A1 May 21, 2015

(51) Int. Cl.
*F25B 13/00* (2006.01)
*F25B 25/00* (2006.01)

(52) U.S. Cl.
CPC ..... *F25B 13/00* (2013.01); *F25B 25/005* (2013.01); *F25B 2313/006* (2013.01);
(Continued)

(58) Field of Classification Search
CPC ..... F25B 2313/0233; F25B 2313/0231; F25B 2400/13; F25B 2313/006; F25B 2400/23; F25B 25/005
(Continued)

(56) References Cited

U.S. PATENT DOCUMENTS 5,063,752 A * 11/1991 Nakamura ..... F24F 3/065 62/160
5,704,219 A * 1/1998 Suzuki ..... B60H 1/00907 237/2 B
(Continued)

FOREIGN PATENT DOCUMENTS

JP 4 359767 12/1992
JP 5 215427 8/1993
(Continued)

OTHER PUBLICATIONS

International Search Report issued Jul. 24, 2012 in PCT/JP12/003135 Filed May 14, 2012.
(Continued)

*Primary Examiner* — Len Tran
*Assistant Examiner* — Kirstin Oswald
(74) *Attorney, Agent, or Firm* — Oblon, McClelland, Maier & Neustadt, L.L.P.

(57) ABSTRACT

A multi-room air-conditioning apparatus includes an outdoor unit, a relay unit connected to an outdoor unit by first and second connection pipes, and a plurality of indoor units connected to the relay unit. The outdoor unit includes a second gas-liquid separating device provided on the suction side of the compressor. The suction side of the compressor and the second gas-liquid separating device are connected to each other by a gas-side outlet pipe and a liquid-side outlet pipe.

10 Claims, 6 Drawing Sheets

(52) U.S. Cl.
CPC ..... *F25B 2313/0231* (2013.01); *F25B 2313/0233* (2013.01); *F25B 2313/0272* (2013.01); *F25B 2400/13* (2013.01); *F25B 2400/23* (2013.01)

(58) Field of Classification Search
USPC ..... 62/324.6
See application file for complete search history.

(56) References Cited

U.S. PATENT DOCUMENTS

| | | | | |
|---|---|---|---|---|
| 2011/0088421 | A1* | 4/2011 | Wakamoto | F25B 13/00 62/238.7 |
| 2011/0185754 | A1* | 8/2011 | Yamashita | F24F 3/06 62/132 |
| 2011/0197608 | A1* | 8/2011 | Yamashita | F24F 3/06 62/190 |
| 2011/0302947 | A1* | 12/2011 | Honda | F24D 3/02 62/324.6 |

FOREIGN PATENT DOCUMENTS

| | | |
|---|---|---|
| JP | 2757584 | 5/1998 |
| JP | 3005485 | 1/2000 |
| JP | 2003 254632 | 9/2003 |
| JP | 2009 198099 | 9/2009 |
| JP | 2010 85071 | 4/2010 |
| JP | 2010 156493 | 7/2010 |
| JP | 2011 112233 | 6/2011 |
| WO | 2009 133640 | 11/2009 |

OTHER PUBLICATIONS

Extended European Search Report issued Jun. 13, 2016 in Patent Application No. 12876709.2.

* cited by examiner

MULTI-ROOM AIR-CONDITIONING APPARATUS

TECHNICAL FIELD

The present invention relates to a multi-room air-conditioning apparatus that includes a plurality of indoor units connected to a heat source unit and that is capable of selectively performing cooling or heating on each of the indoor units and is also capable of simultaneous execution of cooling on some indoor units and heating on other indoor units.

BACKGROUND ART

Hitherto, there have been provided multi-room air-conditioning apparatuses, each of which includes a plurality of indoor units connected to a heat source unit (an outdoor unit) and is capable of selectively performing cooling or heating on each of the indoor units and is also capable of simultaneous execution of cooling on some indoor units and heating on other indoor units. For example, Patent Literature 1 discloses the following multi-room air-conditioning apparatus. A heat source unit is connected to a plurality of indoor units by first and second connection pipes via a relay unit. In the heat source unit, a switching valve that reduces the pressure in the first connection pipe and increases the pressure in the second connection pipe is provided between the first and second connection pipes. In the relay unit, the second connection pipe is connected to the plurality of indoor units via respective second flow control devices. Furthermore, pipes that connect the second connection pipe and the plurality of indoor units are connected to the first connection pipe via respective third flow control devices.

Patent Literature 2 discloses the following multi-room air-conditioning apparatus. In a heating operation, a gas-liquid separating device is provided on the inlet side of an outdoor-unit-side heat exchanger, and a gas refrigerant generated by gas-liquid separation is returned to a compressing element on the downstream side.

Patent Literature 3 discloses the following configuration. A heat-source-side gas-liquid separating device that separates a refrigerant into a gas refrigerant and a liquid refrigerant is provided in a heat source unit, and an injection pipe is connected to the heat-source-side gas-liquid separating device and is configured to return, to a compressing element on the downstream side through the injection pipe, the gas refrigerant generated by the gas-liquid separation performed by the heat-source-side gas-liquid separating device.

Patent Literature 4 discloses the following multi-room air-conditioning apparatus. A gas-liquid separating device is provided on the inlet side of an outdoor-unit-side heat exchanger, and, in a heating operation, a gas refrigerant generated by the gas-liquid separation performed by the gas-liquid separating device is supplied to the suction side of a compressor.

CITATION LIST

Patent Literature

Patent Literature 1: Japanese Unexamined Patent Application Publication No. 4-359767 (FIG. 1)

Patent Literature 2: Japanese Unexamined Patent Application Publication No. 2010-156493 (FIGS. 8 and 9)

Patent Literature 3: Japanese Unexamined Patent Application Publication No. 2010-85071 (FIGS. 5 and 6)

Patent Literature 4: Japanese Unexamined Patent Application Publication No. 5-215427 (FIG. 3)

SUMMARY OF INVENTION

Technical Problem

In Patent Literature 1, however, no gas-liquid separating device is provided on the inlet side of an outdoor-unit-side heat exchanger. Therefore, in a heating operation or a heating main operation, when a two-phase refrigerant that has flowed out of the plurality of indoor units flows into the outdoor unit, a gas refrigerant that is not necessary for heat exchange flows into the outdoor-unit-side heat exchanger. Consequently, a problem arises in that the pressure loss in the outdoor-unit-side heat exchanger may increase.

In each of Patent Literatures 2 and 3, the gas-liquid separating device is provided on the inlet side of the outdoor-unit-side heat exchanger. Furthermore, a gas-side outlet pipe is connected to the suction side of the compressor such that a gas refrigerant generated by the gas-liquid separation performed by the gas-liquid separating device is extracted and is supplied to the suction side of the compressor. Nevertheless, the direction in which the refrigerant flows at the inlet of the gas-liquid separating device is not constant.

In Patent Literature 4, no relay unit that distributes the refrigerant to a plurality of indoor units is provided. Therefore, a simultaneous operation of cooling and heating on one or a plurality of indoor units cannot be performed.

The present invention has been made to solve the above problems and has as its object to provide a multi-room air-conditioning apparatus in which the pressure loss in an outdoor-unit-side heat exchanger can be reduced and the temperature of a refrigerant sucked into a compressor can be maintained high.

Solution to Problem

A multi-room air-conditioning apparatus according to the present invention includes an outdoor unit that includes at least a compressor, a four-way switching valve, and an outdoor-unit-side heat exchanger, a relay unit that is connected to the outdoor unit by a first connection pipe and a second connection pipe, and a plurality of indoor units, each of which includes an indoor heat exchanger and a first flow control device and which are connected to the relay unit while being arranged in parallel. The outdoor unit includes a first route along which a refrigerant that is discharged from the compressor is guided to the second connection pipe via the four-way switching valve and the outdoor-unit-side heat exchanger, and a second route along which the refrigerant is guided to the second connection pipe via the four-way switching valve while bypassing the outdoor-unit-side heat exchanger, so that the refrigerant is guided in accordance with operation modes including a cooling operation mode, a heating operation mode, a cooling main operation mode, and a heating main operation mode. The relay unit includes a first gas-liquid separating device that is connected to an intervening portion of the second connection pipe, a plurality of switching units that individually connect the indoor units to one of the first connection pipe and the second connection pipe selectively, a first bypass pipe that connects the first gas-liquid separating device to each of the indoor units, a second bypass pipe that connects the first connection pipe to the first bypass pipe, a second flow control device provided to the first bypass pipe, and a second flow control device provided to the second bypass pipe. The multi-room air-conditioning apparatus further includes a second gas-liquid separating device provided between the outdoor unit and the relay unit and connected to the first connection pipe, and a gas-side outlet pipe and a liquid-side outlet pipe that allow a gas refrigerant and a liquid refrigerant, respectively, generated by gas-liquid separation performed by the second gas-liquid separating device to bypass the outdoor-unit-side heat exchanger and to flow into a refrigerant suction port of the compressor.

Advantageous Effects of Invention

The multi-room air-conditioning apparatus according to the present invention is configured as described above. Hence, in the heating operation or in the heating main operation, a gas refrigerant that is contained in a two-phase refrigerant having flowed out of the plurality of indoor units and is not necessary for heat exchange is bypassed by the second gas-liquid separating device, whereby only the liquid refrigerant that is necessary for heat exchange flows into the outdoor-unit-side heat exchanger. Therefore, the pressure loss in the outdoor-unit-side heat exchanger can be reduced. Furthermore, the refrigerant that flows into the outdoor-unit-side heat exchanger is in a substantially liquid state, that is, the refrigerant to be distributed is substantially single-phase. Therefore, the distribution of refrigerant can also be improved. Furthermore, the direction in which the refrigerant flows in the second gas-liquid separating device is constant. Hence, the gas refrigerant that has flowed into the second gas-liquid separating device not only in the heating operation or the heating main operation but also in the cooling operation or the cooling main operation can flow into the gas-side outlet pipe and into the liquid-side outlet pipe. Consequently, the suction pressure loss in the compressor can be reduced, the temperature of a refrigerant sucked into the compressor is maintained high, and the performance of the compressor can be maintained high.

DESCRIPTION OF EMBODIMENTS

Figure 1:
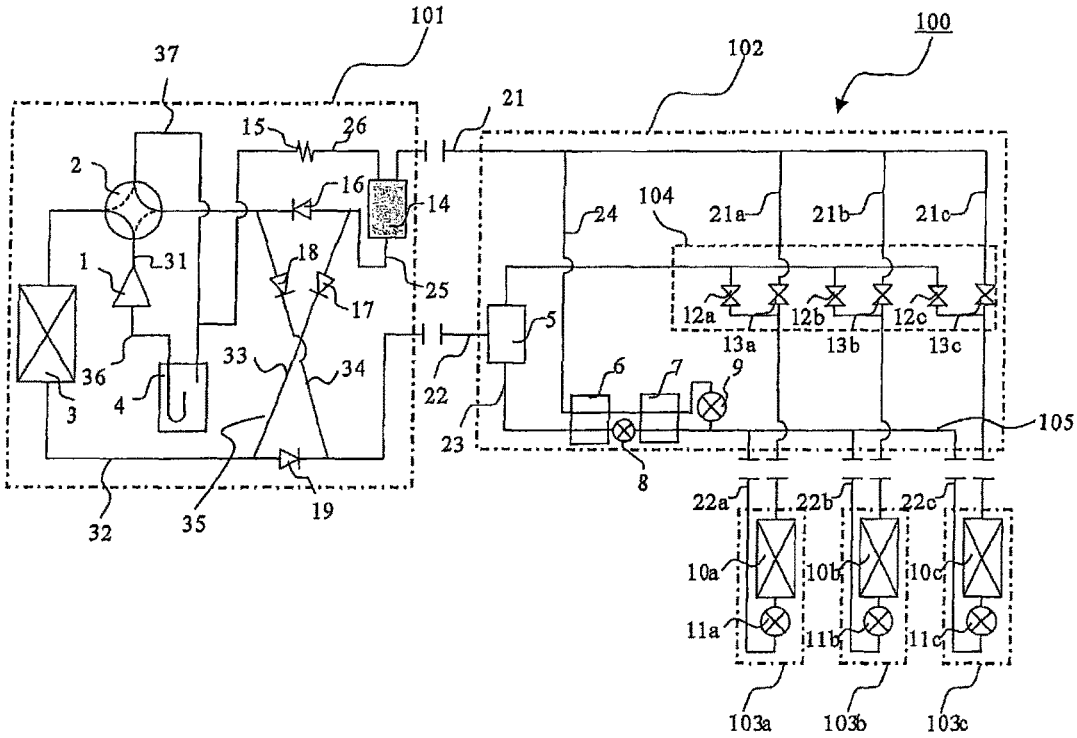
FIG. 1 is a refrigerant circuit diagram illustrating an exemplary refrigerant circuit configuration of an air-conditioning apparatus according to Embodiment 1 of the present invention.

Embodiments of the air-conditioning apparatus according to the present invention will now be described with reference to the drawings. The same reference numerals denote the same or equivalent elements in all the drawings including FIG. 1, which applies to the specification in its entirety.

Embodiment 1

FIG. 1 is a refrigerant circuit diagram illustrating an exemplary refrigerant circuit configuration of a multi-room air-conditioning apparatus 100 according to Embodiment 1 of the present invention. The refrigerant circuit configuration of the multi-room air-conditioning apparatus 100 will now be described with reference to FIG. 1.

The multi-room air-conditioning apparatus 100 according to Embodiment 1 includes an outdoor unit (to be also referred to as a heat source unit hereinafter) 101, a relay unit 102, and a plurality of indoor units 103. While Embodiment 1 assumes that one relay unit and three indoor units are connected to one outdoor unit, Embodiment 1 also applies to the case where two or more outdoor units, two or more relay units, and two or more indoor units are connected to one another.

The configurations of the individual devices will now be described in further detail.

(Configuration of Outdoor Unit 101)

The outdoor unit 101 includes a compressor 1 that compresses and discharges a refrigerant, a four-way switching valve 2 serving as a switching valve that switches the direction in which the refrigerant flows in the outdoor unit 101, an outdoor-unit-side heat exchanger 3, an accumulator 4, and a gas-liquid separating device (a second gas-liquid separating device) 14. The inlet of the second gas-liquid separating device 14 is connected to a first connection pipe 21 included in the relay unit 102 (to be described below). A liquid-side outlet pipe 25 through which a liquid refrigerant generated by the gas-liquid separation performed by the second gas-liquid separating device 14 flows out of the second gas-liquid separating device 14 is connected to the four-way switching valve 2 via a check valve 16. The check valve 16 allows the liquid refrigerant to flow only in the direction from the second gas-liquid separating device 14 toward the four-way switching valve 2. A gas-side outlet pipe 26 through which a gas refrigerant generated by the gas-liquid separation performed by the second gas-liquid separating device 14 flows out of the second gas-liquid separating device 14 is connected to the inlet or to the interior of the accumulator 4 via a gas-side bypass passage resistor 15. Thus, the refrigerant flows in the second gas-liquid separating device 14 in a constant direction toward the suction side of the compressor 1.

The compressor 1, the four-way switching valve 2, and the outdoor-unit-side heat exchanger 3 are connected to one another in that order by a discharge pipe 31. The outdoor-unit-side heat exchanger 3 is also connected to the relay unit 102 by a refrigerant pipe 32, which is provided with a check valve 19, via a second connection pipe 22 that is narrower than the first connection pipe 21. The check valve 19 is configured to allow the refrigerant to flow only in the direction from the outdoor-unit-side heat exchanger 3 toward the second connection pipe 22. The liquid-side outlet pipe 25 and the refrigerant pipe 32 are connected to each other by a short-circuit pipe 33 provided with a check valve 17 and by a short-circuit pipe 34 provided with a check valve 18. The check valves 17 and 18 each allow the refrigerant to flow only in the direction from the liquid-side outlet pipe 25 toward the refrigerant pipe 32. A circuit including the check valves 16, 17, 18, and 19 forms a passage switching circuit 35 on the outdoor-unit side.

The outlet of the accumulator 4 and the suction port of the compressor 1 are connected to each other by a suction pipe 36. The four-way switching valve 2 and the accumulator 4 are connected to each other by a refrigerant pipe 37.

While the following description assumes that an air-cooled outdoor-unit-side heat exchanger is used as an exemplary example of the outdoor-unit-side heat exchanger 3, the outdoor-unit-side heat exchanger 3 may be of any other type, such as a water-cooled outdoor-unit-side heat exchanger, as long as the refrigerant exchanges heat with another fluid.

(Configuration of Relay Unit 102)

The outdoor unit 101 configured as described above and the relay unit 102 are connected to each other by the first connection pipe 21, which is relatively wide, and by the second connection pipe 22, which is narrower than the first connection pipe 21.

The relay unit 102 includes an intra-relay-unit gas-liquid separating device (a first gas-liquid separating device) 5 that is connected to an intervening portion of the second connection pipe 22. A gas-phase portion of the first gas-liquid separating device 5 is connected to first branch pipes 21*a*, 21*b*, and 21*c*, which are provided to indoor units 103*a*, 103*b*, and 103*c*, respectively, that are connected in parallel, via solenoid valves 12*a*, 12*b*, and 12*c*, respectively. The first branch pipes 21*a*, 21*b*, and 21*c* are connected to indoor heat exchangers 10*a*, 10*b*, and 10*c*, respectively, which are included in the indoor units 103*a*, 103*b*, and 103*c*, respectively, via solenoid valves 13*a*, 13*b*, and 13*c*, respectively. A portion of the circuit that includes the solenoid valves 12*a*, 12*b*, and 12*c* and the solenoid valves 13*a*, 13*b*, and 13*c* will be referred to as a "switching unit 104" hereinafter.

A liquid-phase portion of the first gas-liquid separating device 5 is connected to a first bypass pipe 23. The first bypass pipe 23 is connected to the indoor units 103*a*, 103*b*, and 103*c* via respective branch pipes 22*a*, 22*b*, and 22*c*.

A second bypass pipe 24 branches off from the first connection pipe 21. The other end of the second bypass pipe 24 is connected to the first bypass pipe 23. Each of a first heat exchanger 6 and a second heat exchanger 7 is provided in intervening portions of both the first bypass pipe 23 and the second bypass pipe 24. Refrigerants flowing through the respective bypass pipes 23 and 24 exchange heat with each other in each of the first heat exchanger 6 and the second heat exchanger 7. A third flow control device 8 that is openable and closable is provided in a portion of the first bypass pipe 23 that extends between the first heat exchanger 6 and the second heat exchanger 7. A second flow control device 9 that is openable and closable is provided between the second heat exchanger 7 and a connected portion at the other end of the second bypass pipe 24 (a portion of the second bypass pipe 24 that is connected to the first bypass pipe 23).

(Configuration of Indoor Units 103)

The indoor units 103*a*, 103*b*, and 103*c* are connected such that the refrigerant circulates therethrough via the respective first branch pipes 21*a*, 21*b*, and 21*c* included in the relay unit 102 and via the respective branch pipes 22*a*, 22*b*, and 22*c* branching off from the first bypass pipe 23. The indoor units 103*a*, 103*b*, and 103*c* include the respective indoor heat exchangers 10*a*, 10*b*, and 10*c*, and respective first flow control devices 11*a*, 11*b*, and 11*c* that are openable and closable. The first flow control devices 11*a*, 11*b*, and 11*c* are provided near and are connected to the respective indoor heat exchangers 10*a*, 10*b*, and 10*c*. The first flow control devices 11*a*, 11*b*, and 11*c* are adjusted in accordance with, in a cooling operation, the degrees of superheat and, in a heating operation, the degrees of supercooling on the outlet side of the respective indoor heat exchangers 10*a*, 10*b*, and 10*c*.

Behaviors in various types of operations performed by the multi-room air-conditioning apparatus 100 will now be described. The multi-room air-conditioning apparatus 100 has four operation modes: a cooling operation mode, a heating operation mode, a cooling main operation mode, and a heating main operation mode.

The cooling operation mode is an operation mode in which indoor units that are in operation all perform cooling. The heating operation mode is an operation mode in which indoor units that are in operation all perform heating. The cooling main operation mode is an operation mode in which some indoor units perform cooling while others perform heating, and the cooling load is higher than the heating load. The heating main operation mode is an operation mode in which some indoor units perform cooling while others perform heating, and the heating load is higher than the cooling load.

In the cooling main operation mode, the outdoor-unit-side heat exchanger 3 is connected to the discharge side of the compressor 1 and functions as a condenser (radiator). In the heating main operation mode, the outdoor-unit-side heat exchanger 3 is connected to the suction side of the compressor 1 and functions as an evaporator. The flow of the refrigerant in each of the operation modes will now be described with reference to a corresponding one of P-h charts.

(Heating Operation Mode)

Figure 2:
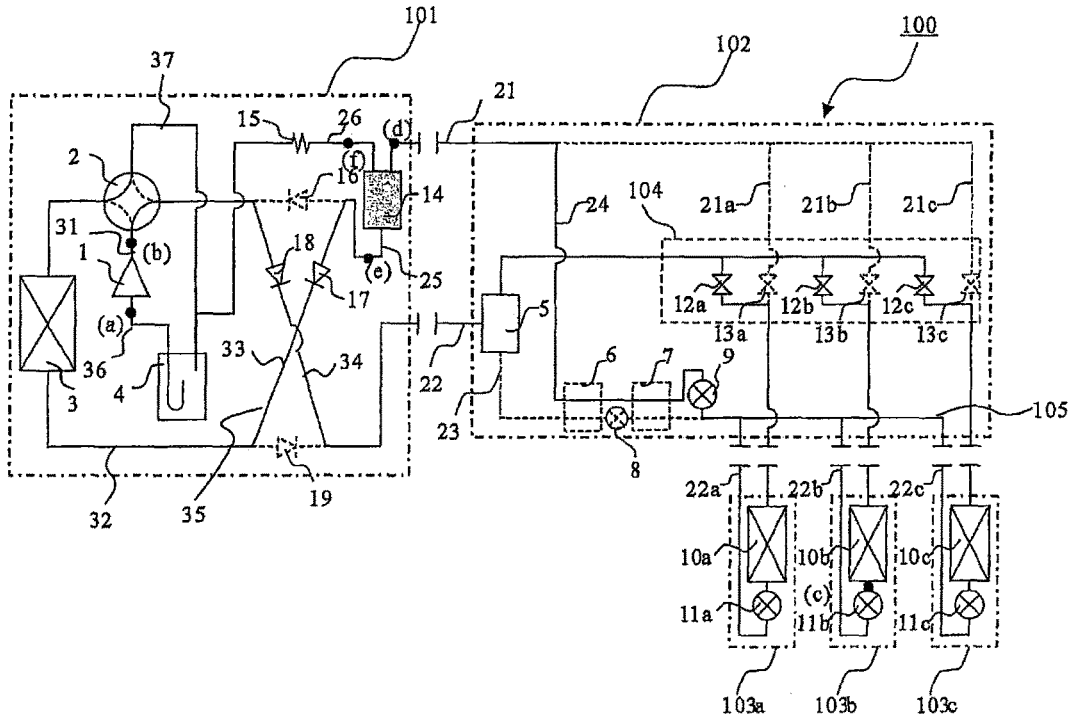
FIG. 2 is a refrigerant circuit diagram illustrating the flow of a refrigerant that occurs when the air-conditioning apparatus according to Embodiment 1 of the present invention performs a heating operation.

FIG. 2 is a refrigerant circuit diagram illustrating the flow of the refrigerant in the heating operation. The following description assumes that all of the indoor units 103*a*, 103*b*, and 103*c* are about to perform heating.

When the heating operation is to be performed, the four-way switching valve 2 is switched such that the refrigerant, as discharged from the compressor 1, flows through the second connection pipe 22 while bypassing the outdoor-unit-side heat exchanger 3, and flows into the switching unit 104 including the solenoid valves 12*a*, 12*b*, and 12*c* and the solenoid valves 13*a*, 13*b*, and 13*c*. In the switching unit 104, the solenoid valves 13*a*, 13*b*, and 13*c* provided in the respective first branch pipes 21*a*, 21*b*, and 21*c* are controlled to be closed, and the solenoid valves 12*a*, 12*b*, and 12*c* provided in respective pipes that connect the second connection pipe 22 to the indoor units 103*a*, 103*b*, and 103*c* are controlled to be open. In FIG. 2, pipes and devices indicated by solid lines form a route of circulation of the refrigerant. That is, the refrigerant does not flow through portions indicated by dotted lines.

Figure 3:
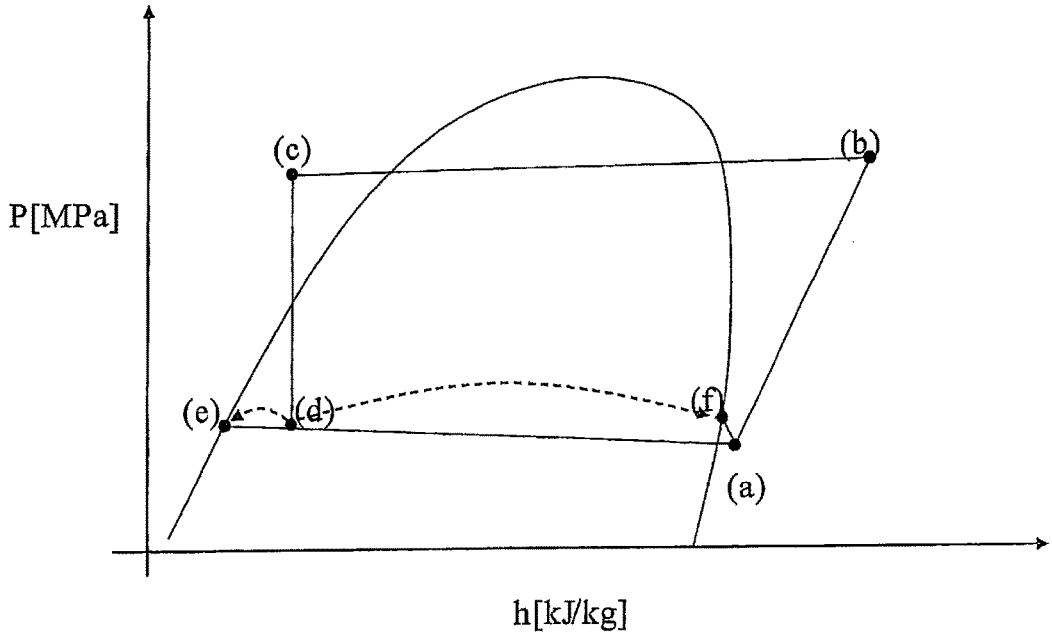
FIG. 3 is a P-h chart when the air-conditioning apparatus according to Embodiment 1 of the present invention performs the heating operation.

FIG. 3 is a P-h chart illustrating changes in the refrigerant that occur in the heating operation. States (a) to (f) of the refrigerant illustrated in FIG. 3 correspond to the states of the refrigerant at respective points illustrated in FIG. 2.

The compressor 1 starts to operate with the refrigerant being in the state illustrated in FIG. 3. Specifically, a low-temperature, low-pressure gas refrigerant is compressed by the compressor 1 into a high-temperature, high-pressure gas refrigerant, which is discharged from the compressor 1. The process of compression of the refrigerant by the compressor 1 is represented by a line extending from point (a) to point (b) in FIG. 3.

The high-temperature, high-pressure gas refrigerant that has been discharged from the compressor 1 flows through the four-way switching valve 2, the short-circuit pipe 34, the check valve 18, the second connection pipe 22, and the first gas-liquid separating device 5 into the switching unit 104. The high-temperature, high-pressure gas refrigerant that has flowed into the switching unit 104 is split into refrigerant streams in the switching unit 104. The refrigerant streams flow through the respective solenoid valves 12*a*, 12*b*, and 12*c* into the respective indoor heat exchangers 10*a*, 10*b*, and 10*c*. Then, the refrigerant streams are heated while cooling the indoor air, thereby turning into intermediate-temperature, high-pressure liquid refrigerant streams. The change in the states of the refrigerant streams in the indoor heat exchangers 10*a*, 10*b*, and 10*c* is represented by a slightly inclined, nearly horizontal line extending from point (b) to point (c) in FIG. 3.

The intermediate-temperature, high-pressure liquid refrigerant streams that have flowed out of the indoor heat exchangers 10*a*, 10*b*, and 10*c* flow into the respective first flow control devices 11*a*, 11*b*, and 11*c* and merge in a second branch portion 105 including the branch pipes 22*a*, 22*b*, and 22*c*. The merged refrigerant flows into the second flow control device 9. The high-pressure liquid refrigerant is throttled by the second flow control device 9 so as to be expanded and decompressed to a low-temperature, low-pressure, two-phase gas-liquid state. The change in the state of the refrigerant upon this process is represented by a vertical line extending from point (c) to point (d) in FIG. 3.

The low-temperature, low-pressure, two-phase gas-liquid refrigerant that has flowed out of the second flow control device 9 flows through the first bypass pipe 24 and the first connection pipe 21 into the second gas-liquid separating device 14 included in the outdoor unit 101. A gas refrigerant generated by the gas-liquid separation performed by the second gas-liquid separating device 14 flows through the gas-side outlet pipe 26 and the gas-side bypass passage resistor 15 into the inlet or into the interior of the accumulator 4. A liquid refrigerant generated by the gas-liquid separation performed by the second gas-liquid separating device 14 flows through the liquid-side outlet pipe 25, the short-circuit pipe 33, and the check valve 17 into the outdoor-unit-side heat exchanger 3, where it is heated while cooling the outdoor air, thereby turning into a low-temperature, low-pressure gas refrigerant.

The change in the state of the refrigerant in the second gas-liquid separating device 14 is represented in FIG. 3 by a dashed arrow drawn from point (d) to point (f) for the gas refrigerant generated by the gas-liquid separation and a dashed arrow drawn from point (d) to point (e) for the liquid refrigerant generated by the gas-liquid separation. On the other hand, the change in the state of the refrigerant in the outdoor-unit-side heat exchanger 3 is represented by a slightly inclined, nearly horizontal line extending from point (e) to point (a) in FIG. 3. Upon the change in the state of the refrigerant from point (e) to point (a) that occurs in the outdoor-unit-side heat exchanger 3, a part of the gas refrigerant is bypassed by the second gas-liquid separating device 14. Therefore, the pressure loss in the outdoor-unit-side heat exchanger 3 can be reduced.

The low-temperature, low-pressure gas refrigerant that has flowed out of the outdoor-unit-side heat exchanger 13 flows through the four-way switching valve 12, and merges with the gas refrigerant generated by the gas-liquid separation performed by the second gas-liquid separating device 14 at the inlet or in the interior of the accumulator. Then, the merged refrigerant flows into the compressor 1 and is compressed. Thereafter, the refrigerant circulates along the above-described route.

(Cooling Operation Mode)

Figure 4:
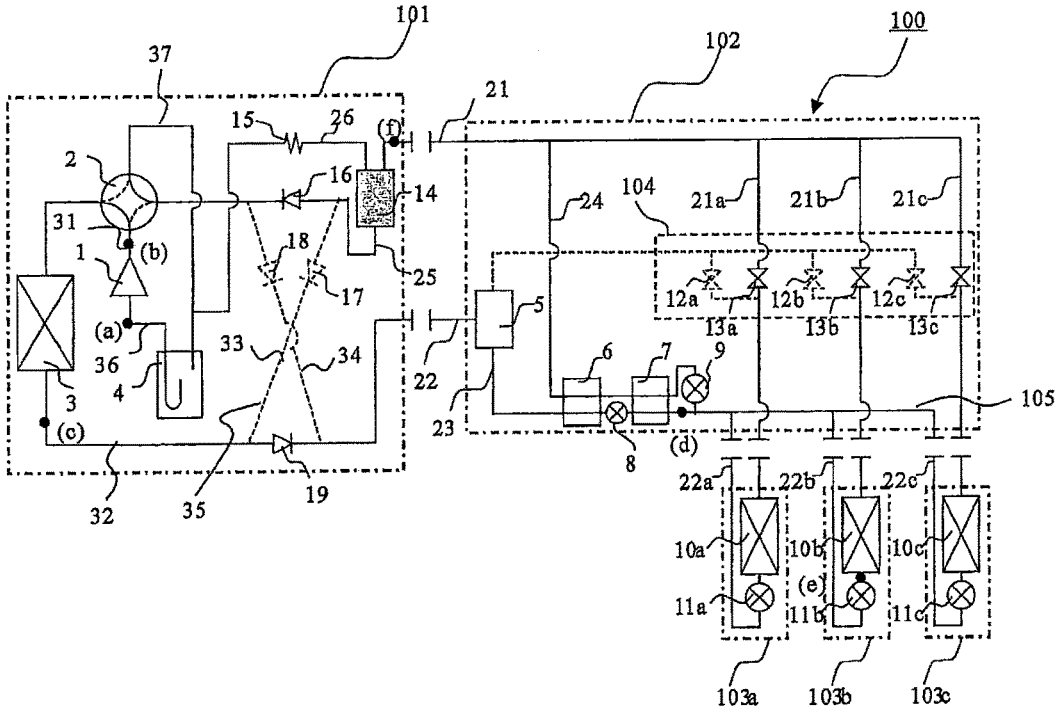
FIG. 4 is a refrigerant circuit diagram illustrating the flow of the refrigerant that occurs when the air-conditioning apparatus according to Embodiment 1 of the present invention performs a cooling operation.

FIG. 4 is a refrigerant circuit diagram illustrating the flow of the refrigerant in the cooling operation. The following description assumes that all of the indoor units 103*a*, 103*b*, and 103*c* are about to perform cooling.

When cooling is to be performed, the four-way switching valve 2 is switched such that the refrigerant, as discharged from the compressor 1, flows into the outdoor-unit-side heat exchanger 3. In the switching unit 104, the solenoid valves 13*a*, 13*b*, and 13*c* connected to the indoor units 103*a*, 103*b*, and 103*c* are controlled to be open, and the solenoid valves 12*a*, 12*b*, and 12*c* are controlled to be closed. In FIG. 4, pipes and devices indicated by solid lines form a route of circulation of the refrigerant. That is, the refrigerant does not flow through portions indicated by dotted lines.

Figure 5:
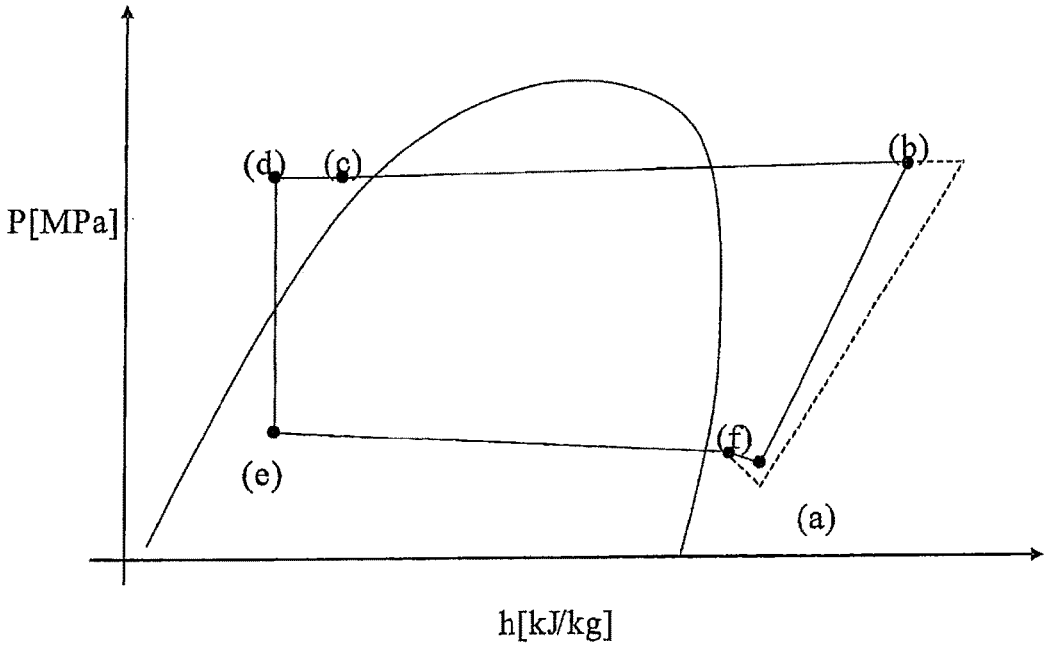
FIG. 5 is a P-h chart when the air-conditioning apparatus according to Embodiment 1 of the present invention performs the cooling operation.

FIG. 5 is a P-h chart illustrating changes in the refrigerant that occur in the cooling operation. The states of the refrigerant at points (a) to (f) illustrated in FIG. 5 correspond to the states of the refrigerant at respective points illustrated in FIG. 4.

The compressor 1 starts to operate with the refrigerant being in the state illustrated in FIG. 5. Specifically, a low-temperature, low-pressure gas refrigerant is compressed by the compressor 1 into a high-temperature, high-pressure gas refrigerant, which is discharged from the compressor 1. In the process of compression of the refrigerant by the compressor 1, the refrigerant is compressed while being heated, rather than being compressed adiabatically along an isentropic line in correspondence with the adiabatic efficiency of the compressor 1. This process is represented by a line extending from point (a) to point (b) in FIG. 5.

The high-temperature, high-pressure gas refrigerant that has been discharged from the compressor 1 flows through the four-way switching valve 2 into the outdoor-unit-side heat exchanger 3. Upon this process, the refrigerant is cooled by heating the outdoor air, thereby turning into an intermediate-temperature, high-pressure liquid refrigerant. The change in the state of the refrigerant in the outdoor-unit-side heat exchanger 3 is represented by a slightly inclined, nearly horizontal line extending from point (b) to point (c) in FIG. 5, when the pressure loss in the outdoor-unit-side heat exchanger 3 is taken into consideration.

The intermediate-temperature, high-pressure liquid refrigerant, upon flowing out of the outdoor-unit-side heat exchanger 3, flows through the check valve 19, the second connection pipe 22, the first gas-liquid separating device 5, the first bypass pipe 23, and the third flow control device 8 while exchanging heat with a refrigerant flowing through the second bypass pipe 24 in the first heat exchanger 6 and the second heat exchanger 7, whereby the intermediate-temperature, high-pressure liquid refrigerant is cooled. The process of cooling at this time is represented by a nearly horizontal line extending from point (c) to point (d) in FIG. 5.

The liquid refrigerant that has been cooled in the first and second heat exchangers 6 and 7 flows into the second branch portion 105 including the branch pipes 22*a*, 22*b*, and 22*c* while a part thereof is bypassed to proceed along the second bypass pipe 24. The other part of the high-pressure liquid refrigerant that has flowed into the second branch portion 105 is split into refrigerant streams in the second branch portion 105, and the refrigerant streams flow into the respective first flow control devices 11*a*, 11*b*, and 11*c*. The high-pressure liquid refrigerant streams are throttled by the first flow control devices 11*a*, 11*b*, and 11*c* so as to be expanded and decompressed to a low-temperature, low-pressure, two-phase gas-liquid state. The change in the states of the refrigerant streams in the first flow control devices 11*a*, 11*b*, and 11*c* occurs with a constant enthalpy. The change in the states of the refrigerant streams upon this process is represented by a vertical line extending from point (d) to point (e) in FIG. 5.

The low-temperature, low-pressure, two-phase gas-liquid refrigerant streams that have flowed out of the first flow control devices 11*a*, 11*b*, and 11*c* flow into the respective indoor heat exchangers 10*a*, 10*b*, and 10*c*. Then, the refrigerant streams are heated while cooling the indoor air, thereby turning into low-temperature, low-pressure gas refrigerant streams. The change in the states of the refrigerant streams in the indoor heat exchangers 10*a*, 10*b*, and 10*c* is represented by a slightly inclined, nearly horizontal line extending from point (e) to point (f) in FIG. 5 when the pressure loss is taken into consideration.

The low-temperature, low-pressure gas refrigerant streams that have flowed out of the indoor heat exchangers 10*a*, 10*b*, and 10*c* flow through the respective solenoid valves 13*a*, 13*b*, and 13*c* and merge with the low-temperature, low-pressure gas refrigerant that has been heated in the first and second heat exchangers 6 and 7 provided over the second bypass pipe 24. The merged refrigerant flows into the first connection pipe 21. In the refrigerant circuit, the direction in which the refrigerant flows at the inlet of the first gas-liquid separating device 5 is constant. Therefore, the gas refrigerant that has flowed through the first connection pipe 21 flows into the second gas-liquid separating device 14 and is separated into refrigerant streams flowing along two routes provided by the gas-side outlet pipe 26 and the liquid-side outlet pipe 25, respectively. The gas refrigerant stream that has flowed into the gas-side outlet pipe 26 flows through the gas-side bypass passage resistor 15 into the inlet or the interior of the accumulator 4. The gas refrigerant stream that has flowed into the liquid-side outlet pipe 25 flows through the check valve 16 and the four-way switching valve 2 into the accumulator 4.

The gas refrigerant streams obtained in the second gas-liquid separating device 14 merge at the inlet or in the interior of the accumulator 4. The merged refrigerant flows into the compressor 1 and is compressed. In this process, since the gas refrigerant that has flowed through the first connection pipe 21 is separated into refrigerant streams by the second gas-liquid separating device 14, the cross-sectional area of the passages extending from the second gas-liquid separating device 14 to the accumulator 4 is increased. Hence, the pressure loss in those passages can be reduced. Consequently, the temperature on the suction side of the compressor is maintained high, the performance of the compressor 1 is improved, and no check valve, solenoid valve, or the like for controlling the flow needs to be provided in the gas-side outlet pipe 26. The change in the state of the refrigerant that occurs in a portion from the second gas-liquid separating device 14 to the compressor 1 is represented by a line extending from point (f) to point (a) in FIG. 5. If the second gas-liquid separating device 14 is not provided, the state changes as represented by a broken line illustrated in FIG. 5, which deteriorates the performance of the compressor 1.

(Heating Main Operation Mode)

Figure 6:
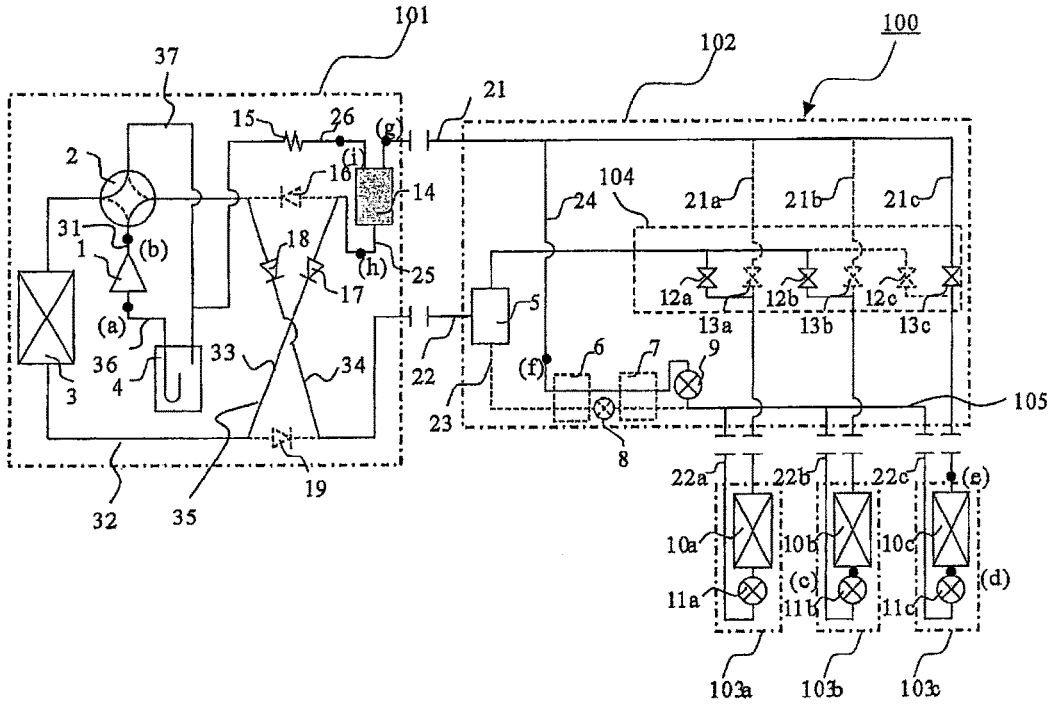
FIG. 6 is a refrigerant circuit diagram illustrating the flow of the refrigerant that occurs when the air-conditioning apparatus according to Embodiment 1 of the present invention performs a heating main operation.

FIG. 6 is a refrigerant circuit diagram illustrating the flow of the refrigerant in the heating main operation. The following description assumes that the indoor unit 103*c* performs cooling while the indoor units 103*a* and 103*b* perform heating. In this case, the four-way switching valve 2 is switched such that the refrigerant, as discharged from the compressor 1, flows through the second connection pipe 22 into the switching unit 104 including the solenoid valves 12*a*, 12*b*, and 12*c* and the solenoid valves 13*a*, 13*b*, and 13*c*. In the switching unit 104, the solenoid valves 13*a*, 13*b*, and 12*c* connected to the indoor units 103*a*, 103*b*, and 103*c* are controlled to be closed, and the solenoid valves 12*a*, 12*b*, and 13*c* are controlled to be open. In FIG. 6, pipes and devices indicated by solid lines form a route of circulation of the refrigerant. That is, the refrigerant does not flow through portions indicated by dotted lines.

Figure 7:
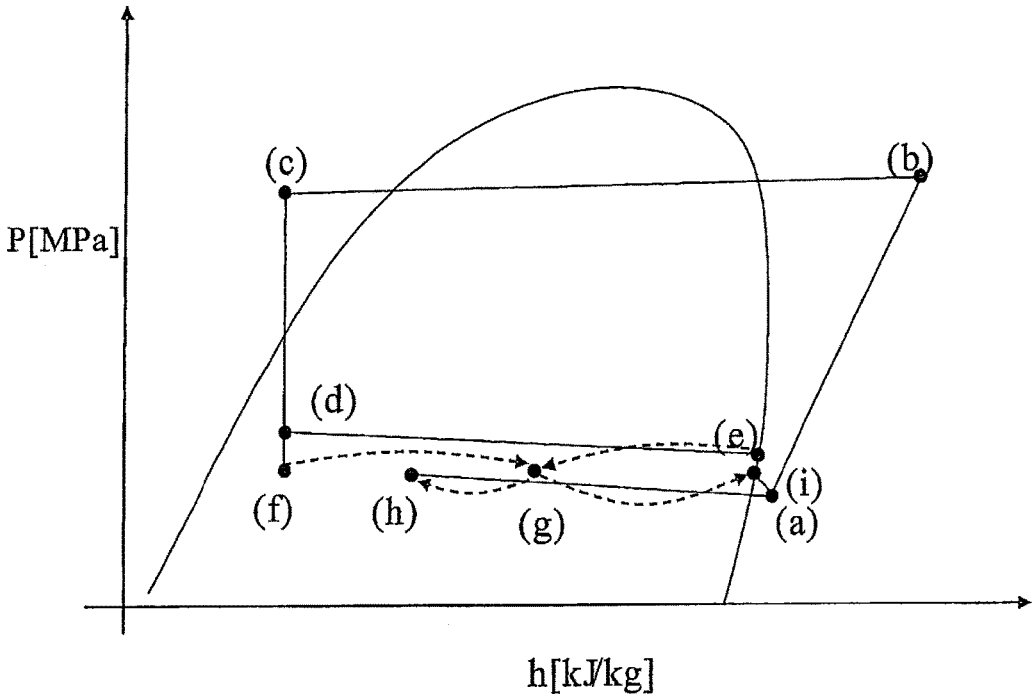
FIG. 7 is a P-h chart when the air-conditioning apparatus according to Embodiment 1 of the present invention performs the heating main operation.

FIG. 7 is a P-h chart illustrating changes in the refrigerant that occur in the heating main operation. States (a) to (i) of the refrigerant illustrated in FIG. 7 correspond to the states of the refrigerant at respective points illustrated in FIG. 6.

The compressor 1 starts to operate with the refrigerant being in the state illustrated in FIG. 7. Specifically, a low-temperature, low-pressure gas refrigerant is compressed by the compressor 1 into a high-temperature, high-pressure gas refrigerant, which is discharged from the compressor 1. The process of compression of the refrigerant by the compressor 1 is represented by a line extending from point (a) to point (b) in FIG. 7.

The high-temperature, high-pressure gas refrigerant that has been discharged from the compressor 1 flows through the four-way switching valve 2, the short-circuit pipe 34, the check valve 18, the second connection pipe 22, and the first gas-liquid separating device 5 into the switching unit 104. The high-temperature, high-pressure gas refrigerant that has flowed into the switching unit 104 is split into refrigerant streams in the switching unit 104. The refrigerant streams flow through the respective solenoid valves 12*a* and 12*b* into the respective indoor heat exchangers 10*a* and 10*b* that perform heating. Then, the refrigerant streams are cooled while heating the indoor air, thereby turning into intermediate-temperature, high-pressure liquid refrigerant streams. The change in the states of the refrigerant streams in the indoor heat exchangers 10*a* and 10*b* is represented by a slightly inclined, nearly horizontal line extending from point (b) to point (c) in FIG. 7.

The intermediate-temperature, high-pressure liquid refrigerant streams that have flowed out of the indoor heat exchangers 10*a* and 10*b* flow into the respective first flow control devices 11*a* and 11*b* and merge in the second branch portion 105 including the branch pipes 22*a*, 22*b*, and 22*c*. A part of the high-pressure liquid refrigerant resulting from the merge in the second branch portion 105 flows into the first flow control device 11*c* connected to the indoor unit 103*c* that performs cooling. The part of the high-pressure liquid refrigerant is throttled by the first flow control device 11*c* so as to be expanded and decompressed to a low-temperature, low-pressure, two-phase gas liquid state. The change in the state of the refrigerant upon this process is represented by a vertical line extending from point (c) to point (d) in FIG. 7. The low-temperature, low-pressure, two-phase gas-liquid refrigerant stream that has flowed out of the first flow control device 11*c* flows into the indoor heat exchanger 10*c* that performs cooling. Then, the refrigerant stream is heated while cooling the indoor air, thereby turning into a low-temperature, low-pressure gas refrigerant stream. The change in the state of the refrigerant stream upon this process is represented by a slightly inclined, nearly horizontal line extending from point (d) to point (e) in FIG. 7. The low-temperature, low-pressure gas refrigerant stream that has flowed out of the indoor heat exchanger 10*c* flows through the solenoid valve 13*c* into the first connection pipe 21.

Meanwhile, the remaining part of the high-pressure liquid refrigerant that has flowed out of the indoor heat exchangers 10*a* and 10*b* that perform heating into the second branch portion 105 flows into the second flow control device 9. Then, the high-pressure liquid refrigerant stream is throttled by the second flow control device 9 so as to be expanded (decompressed) to a low-temperature, low-pressure, two-phase gas-liquid state. The change in the state of the refrigerant stream upon this process is represented by a vertical line extending from point (c) to point (f) in FIG. 7. The low-temperature, low-pressure, two-phase gas-liquid refrigerant stream that has flowed out of the second flow control device 9 flows through the second bypass pipe 24 into the first connection pipe 21, where it merges with the low-temperature, low-pressure vapor refrigerant stream that has flowed from the indoor heat exchanger 10*c* that performs cooling. The change in the state of the refrigerant stream upon this process is represented by a dashed arrow drawn from point (f) to point (g) in FIG. 7.

The low-temperature, low-pressure, two-phase gas-liquid refrigerant resulting from the merge in the first connection pipe 21 flows into the second gas-liquid separating device 14 included in the outdoor unit 101. A gas refrigerant generated by the gas-liquid separation performed by the second gas-liquid separating device 14 flows through the gas-side outlet pipe 26 and the gas-side bypass passage resistor 15 into the inlet or the interior of the accumulator 4. The change in the state of the refrigerant upon this process is represented by a dashed arrow drawn from point (g) to point (i) in FIG. 7. A liquid refrigerant generated by the gas-liquid separation performed by the second gas-liquid separating device 14 flows through the liquid-side outlet pipe 25, the short-circuit pipe 33, and the check valve 17 into the outdoor-unit-side heat exchanger 3. The change in the refrigerant upon this process is represented by a dashed arrow drawn from point (g) to point (h) in FIG. 7. Then, the refrigerant receives heat from the outdoor air, thereby turning into a low-temperature, low-pressure gas refrigerant. The change in the state of the refrigerant upon this process is represented by a slightly inclined, nearly horizontal line extending from point (h) to point (a) in FIG. 7. The low-temperature, low-pressure gas refrigerant, upon flowing out of the outdoor-unit-side heat exchanger 3, flows through the four-way switching valve 2, merges with the gas refrigerant generated by the gas-liquid separation performed by the second gas-liquid separating device 14 at the inlet or in the interior of the accumulator, and flows into the compressor 1, where it is compressed. Upon this process, a part of the gas refrigerant is bypassed by the second gas-liquid separating device 14. Thus, the pressure loss in the outdoor-unit-side heat exchanger 3 can be reduced.

The accumulator 4 may be omitted. In that case, the gas-side outlet pipe 26 is connected to the suction side of the compressor 1.

(Cooling Main Operation Mode)

Figure 8:
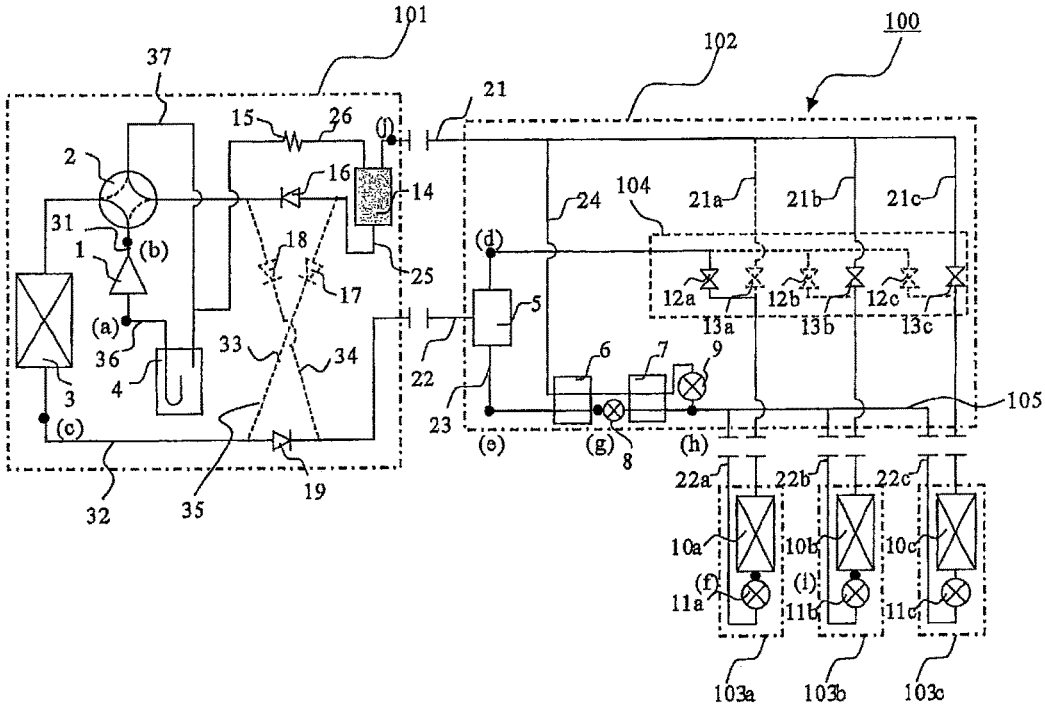
FIG. 8 is a refrigerant circuit diagram illustrating the flow of the refrigerant that occurs when the air-conditioning apparatus according to Embodiment 1 of the present invention performs a cooling main operation.

FIG. 8 is a refrigerant circuit diagram illustrating the flow of the refrigerant in the cooling main operation. The following description assumes that the indoor units 103*b* and 103*c* perform cooling while the indoor unit 103*a* performs heating. In this case, the four-way switching valve 2 is switched such that the refrigerant, as discharged from the compressor 1, flows into the outdoor-unit-side heat exchanger 3. In the switching unit 104, the solenoid valves 12*a*, 13*b*, and 13*c* connected to the indoor units 103*a*, 103*b*, and 103*c* are controlled to be open, and the solenoid valves 13*a*, 12*b*, and 12*c* are controlled to be closed. In FIG. 8, pipes and devices indicated by solid lines form a route of circulation of the refrigerant. That is, the refrigerant does not flow through portions indicated by dotted lines.

Figure 9:
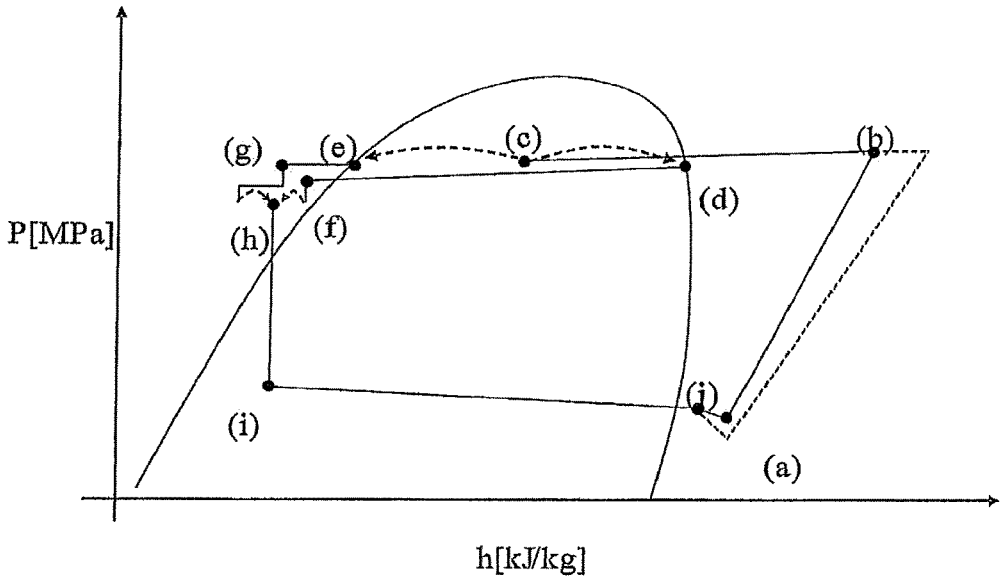
FIG. 9 is a P-h chart when the air-conditioning apparatus according to Embodiment 1 of the present invention performs the cooling main operation.

FIG. 9 is a P-h chart illustrating changes in the refrigerant that occur in the cooling main operation. The states of the refrigerant at points (a) to (j) illustrated in FIG. 9 correspond to the states of the refrigerant at respective points illustrated in FIG. 8.

The compressor 1 starts to operate with the refrigerant being in the state illustrated in FIG. 9. Specifically, a low-temperature, low-pressure gas refrigerant is compressed by the compressor 1 into a high-temperature, high-pressure gas refrigerant, which is discharged from the compressor 1. The process of compression of the refrigerant by the compressor 1 is represented by a line extending from point (a) to point (b) in FIG. 9.

The high-temperature, high-pressure gas refrigerant that has been discharged from the compressor 1 flows through the four-way switching valve 2 into the outdoor-unit-side heat exchanger 3. Upon this process, in the outdoor-unit-side heat exchanger 3, the refrigerant is cooled while heating the outdoor air, with a certain amount of energy required for heating being reserved, whereby the refrigerant falls into an intermediate-temperature, high-pressure, two-phase gas-liquid state. The change in the state of the refrigerant in the outdoor-unit-side heat exchanger 3 is represented by a slightly inclined, nearly horizontal line extending from point (b) to point (c) in FIG. 9.

The intermediate-temperature, high-pressure, two-phase gas-liquid refrigerant, upon flowing out of the outdoor-unit-side heat exchanger 3, flows through the check valve 19 and the second connection pipe 22 into the first gas-liquid separating device 5. Then, in the first gas-liquid separating device 5, the refrigerant is separated into a gas refrigerant (at point (d) in FIG. 8) and a liquid refrigerant (at point (e) in FIG. 8).

The gas refrigerant (at point (d) in FIG. 8) generated by the separation performed by the first gas-liquid separating device 5 flows through the solenoid valve 12*a* into the indoor heat exchanger 10*a* that performs heating. The refrigerant is cooled while heating the indoor air, thereby turning into an intermediate-temperature, high-pressure gas refrigerant. The change in the state of the refrigerant in the indoor heat exchanger 10*a* is represented by a slightly inclined, nearly horizontal line extending from point (d) to point (f) in FIG. 9.

Meanwhile, the liquid refrigerant (at point (e) in FIG. 8) generated by the separation performed by the first gas-liquid separating device 5 flows into the first heat exchanger 6, where it exchanges heat with a low-pressure refrigerant flowing through the second bypass pipe 24 and is thus cooled. The change in the state of the refrigerant in the first heat exchanger 6 is represented by a substantially horizontal line extending from point (e) to point (g) in FIG. 9.

The refrigerant (at point (f) in FIG. 8) that has flowed out of the indoor heat exchanger 10*a* that performs heating flows through the first flow control device 11*a*, and the refrigerant (at point (g) in FIG. 8) that has flowed out of the first heat exchanger 6 flows through the third flow control device 8 and the second heat exchanger 7. Then, the refrigerants merge (at point (h) in FIG. 8).

The liquid refrigerant resulting from the merge at point (h) in FIG. 8 flows into the second branch portion 105 including the branch pipes 22*a*, 22*b*, and 22*c*, with a part thereof being bypassed to proceed along the second bypass pipe 24, and is split into refrigerant streams flowing into the respective first flow control devices 11*b* and 11*c* connected to the indoor units 103*b* and 103*c* that perform cooling. The high-pressure liquid refrigerant streams are throttled by the first flow control devices 11*b* and 11*c* so as to be expanded and decompressed to a low-temperature, low-pressure, two-phase gas-liquid state. The change in the states of the refrigerant streams in the first flow control devices 11*b* and 11*c* occurs with a constant enthalpy. The change in the states of the refrigerant streams upon this process is represented by a vertical line extending from point (h) to point (i) in FIG. 9.

The low-temperature, low-pressure, two-phase gas-liquid refrigerant streams that have flowed out of the first flow control devices 11*b* and 11*c* flow into the respective indoor heat exchangers 10*b* and 10*c* that perform cooling. Then, the refrigerant streams are heated while cooling the indoor air, thereby turning into low-temperature, low-pressure gas refrigerant streams. The change in the states of the refrigerant streams in the indoor heat exchangers 10*b* and 10*c* is represented by a slightly inclined, nearly horizontal line extending from point (i) to point (j) in FIG. 9.

The low-temperature, low-pressure gas refrigerant streams that have flowed out of the indoor heat exchangers 10*b* and 10*c* flow through the respective solenoid valves 13*b* and 13*c*, merge, and flow through the first connection pipe 21. The low-temperature, low-pressure gas refrigerant resulting from the merge in the first connection pipe 21 further merges with the low-temperature, low-pressure gas refrigerant that has been heated in the first and second heat exchangers 6 and 7 provided over the second bypass pipe 24. Thus, the merged refrigerant flows into the first connection pipe 21.

The gas refrigerant that has flowed through the first connection pipe 21 flows into the second gas-liquid separating device 14 included in the outdoor unit 101, and then flows out of it upon being separated into refrigerant streams flowing along two routes provided individually by the gas-side outlet pipe 26 and the liquid-side outlet pipe 25. The gas refrigerant stream that has flowed into the gas-side outlet pipe 26 flows through the gas-side bypass passage resistor 15 into the inlet or the interior of the accumulator 4. The gas refrigerant stream that has flowed into the liquid-side outlet pipe 25 flows through the check valve 16 and the four-way switching valve 2 into the accumulator 4. The gas refrigerant streams obtained in the second gas-liquid separating device 14 merge at the inlet or in the interior of the accumulator 4. The merged refrigerant flows into the compressor 1 and is compressed. In this process, since the gas refrigerant that has flowed through the first connection pipe 21 is separated into refrigerant streams by the second gas-liquid separating device 14, the cross-sectional area of the passages extending from the second gas-liquid separating device 14 to the accumulator 4 is increased. Hence, the pressure loss in those passages can be reduced. Consequently, the temperature on the suction side of the compressor is maintained high, the performance of the compressor 1 is improved, and no check valve, solenoid valve, or the like for flow control needs to be mounted on the gas-side outlet pipe 26.

The change in the state of the refrigerant that occurs across the distance from the second gas-liquid separating device 14 to the compressor 1 is represented by a line extending from point (j) to point (a) in FIG. 9. If the second gas-liquid separating device 14 is not provided, the state changes as represented by a broken line illustrated in FIG. 9, which supposedly deteriorates the performance of the compressor 1.

Embodiment 2

Figure 10:
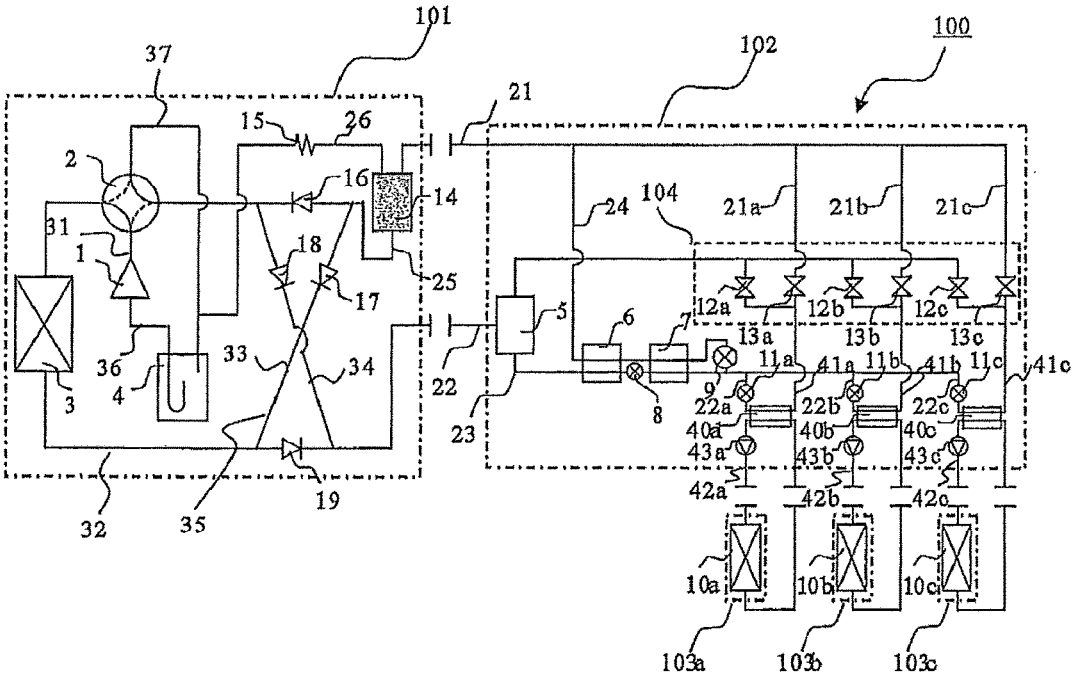
FIG. 10 is a refrigerant circuit diagram illustrating an exemplary refrigerant circuit configuration of an air-conditioning apparatus according to Embodiment 2 of the present invention.

FIG. 10 is a refrigerant circuit diagram illustrating an exemplary refrigerant circuit configuration of a multi-room air-conditioning apparatus 100 according to Embodiment 2 of the present invention. The states of the four-way switching valve 2 and the solenoid valves 12*a*, 12*b*, 12*c*, 13*a*, 13*b*, and 13*c* in each of the operation modes will now be described.

In FIG. 10, the four-way switching valve 2 is switched for the cooling operation. In the cooling operation, the solenoid valves 12*a*, 12*b*, and 12*c* in the relay unit 102 are controlled to be closed, and the solenoid valves 13*a*, 13*b*, and 13*c* are controlled to be open.

In the heating operation, the four-way switching valve 2 is switched such that the refrigerant flows from the compressor 1 into the indoor units 103. Furthermore, in the relay unit 102, the solenoid valves 12*a*, 12*b*, and 12*c* are controlled to be open while the solenoid valves 13*a*, 13*b*, and 13*c* are controlled to be closed.

In the cooling main operation in which, for example, the indoor unit 103*c* performs a heating operation while the indoor units 103*a* and 103*b* each perform a cooling operation, the four-way switching valve 2 is switched such that the refrigerant flows from the compressor 1 into the outdoor-unit-side heat exchanger 3. Furthermore, in the relay unit 102, the solenoid valves 13*a*, 13*b*, and 12*c* are controlled to be open while the solenoid valves 12*a*, 12*b*, and 13*c* are controlled to be closed.

In the heating main operation in which, for example, the indoor unit 103*c* performs a cooling operation while the indoor units 103*a* and 103*b* each perform a heating operation, the four-way switching valve 2 is switched such that the refrigerant flows from the compressor 1 into the indoor units 103. Furthermore, in the relay unit 102, the solenoid valves 12*a*, 12*b*, and 13*c* are controlled to be open while the solenoid valves 13*a*, 13*b*, and 12*c* are controlled to be closed.

Embodiment 2 employs relay-unit-side refrigerant circuits 41 and indoor-unit-side refrigerant circuits 42 through which different refrigerants circulate in the following way, with an intermediate heat exchanger 40 being interposed between each of the refrigerant circuits 41 and a corresponding one of the refrigerant circuits 42. That is, the branch pipes 22*a*, 22*b*, and 22*c* are connected to the respective first branch pipes 21*a*, 21*b*, and 21*c*, whereby closed refrigerant circuits 41*a*, 41*b*, and 41*c* are formed so that one of the refrigerants circulates through the outdoor unit 101 and the relay unit 102 that is connected to the outdoor unit 101 by the first and second connection pipes 21 and 22. The refrigerant circuits 41*a*, 41*b*, and 41*c* are provided with first flow control devices 11*a*, 11*b*, and 11*c*, respectively.

Meanwhile, other closed refrigerant circuits 42*a*, 42*b*, and 42*c* are formed so that a refrigerant (such as water or an antifreeze) that is different from the foregoing circulates through each of the indoor heat exchangers 10*a*, 10*b*, and 10*c* of the indoor units 103*a*, 103*b*, and 103*c*. The refrigerant circuits 42*a*, 42*b*, and 42*c* are provided with pumps 43*a*, 43*b*, and 43*c*, respectively. Intermediate heat exchangers 40*a*, 40*b*, and 40*c* are interposed between the relay-unit-side refrigerant circuits 41*a*, 41*b*, and 41*c*, respectively, and the indoor-unit-side refrigerant circuits 42*a*, 42*b*, and 42*c*, respectively. Thus, the refrigerants that flow through the refrigerant circuits 41 and 42 exchange heat with each other in the intermediate heat exchangers 40. Other functions and configurations are the same as those described in Embodiment 1.

With the aforementioned operation, even if different refrigerants flow through the relay-unit-side refrigerant circuits 41 and the indoor-unit-side refrigerant circuits 42, the same advantageous effects as in Embodiment 1 can be produced.

Embodiment 3

Figure 11:
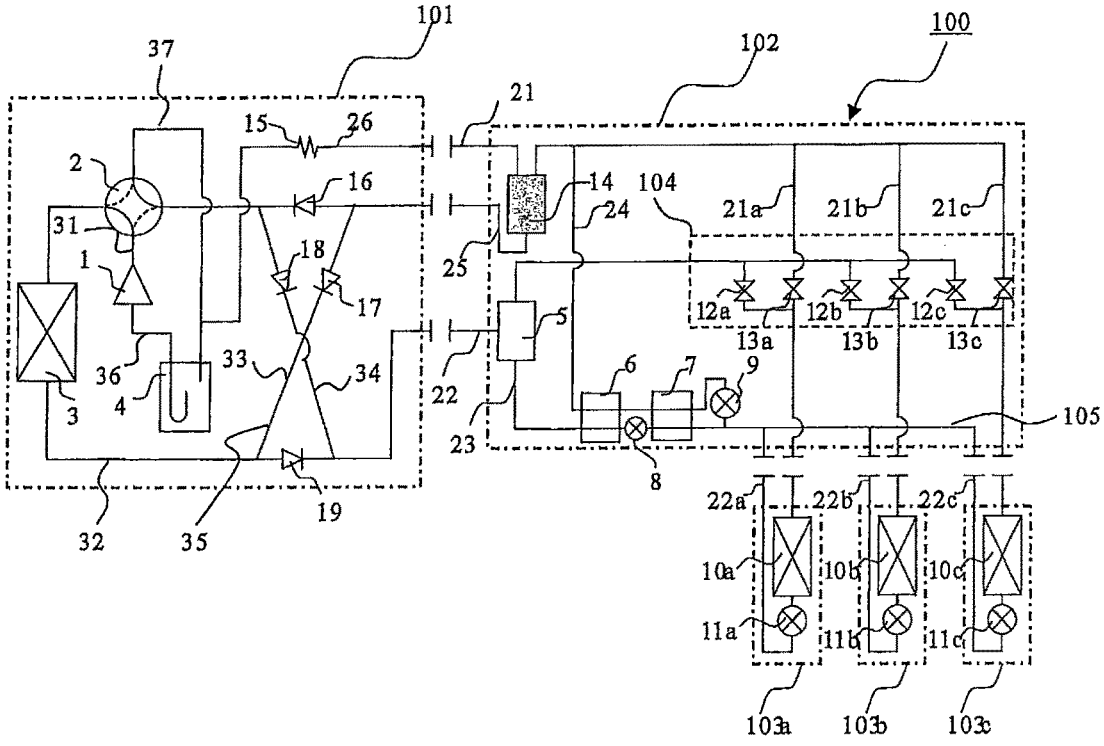
FIG. 11 is a refrigerant circuit diagram illustrating an exemplary refrigerant circuit configuration of an air-conditioning apparatus according to Embodiment 3 of the present invention.

FIG. 11 is a refrigerant circuit diagram illustrating an exemplary refrigerant circuit configuration of a multi-room air-conditioning apparatus 100 according to Embodiment 3.

In Embodiment 3, the second gas-liquid separating device 14 is provided in the relay unit 102. By providing the second gas-liquid separating device 14 in the relay unit 102, the gas refrigerant or the liquid refrigerant generated by the gas-liquid separation flows through the first connection pipe 21. Therefore, the pressure loss can significantly be reduced by an amount corresponding to the length of extension pipes provided between the outdoor unit 101 and the relay unit 102. Other functions and configurations are the same as those described in Embodiments 1 and 2.

Embodiment 4

Zeotropic Refrigerant Mixture

If the above-mentioned refrigerant is a zeotropic refrigerant mixture (such as R404A, R407C, or the like) rather than a single-component refrigerant (such as R22 or the like) or an azeotropic refrigerant mixture (such as R502, R507A, or the like), a refrigerant contained in the zeotropic refrigerant mixture generated by the gas-liquid separation performed by the second gas-liquid separating device 14 and has a low boiling point is bypassed as a gas refrigerant. A liquid refrigerant generated by the gas-liquid separation flows out as a zeotropic refrigerant mixture in which the composition percentage of a refrigerant component having a higher boiling point is higher than that at the inlet of the second gas-liquid separating device 14. Therefore, in addition to the advantageous effect of reducing the pressure loss in the outdoor-unit-side heat exchanger, an advantageous effect of easing the temperature gradient (temperature glide) of the zeotropic refrigerant mixture in the two-phase state that may deteriorate the performance of the zeotropic refrigerant mixture is produced. Other functions and configurations are the same as those described in Embodiments 1 to 3.

REFERENCE SIGNS LIST

1 compressor 2 four-way switching valve 3 outdoor-unit-side heat exchanger 4 accumulator 5 first gas-liquid separating device 6 first heat exchanger 7 second heat exchanger 8 third flow control device 9 second flow control device 10 (10*a*, 10*b*, 10*c*) indoor heat exchanger 11 (11*a*, 11*b*, 11*c*) first flow control device 12 (12*a*, 12*b*, 12*c*) solenoid valve 13 (13*a*, 13*b*, 13*c*) solenoid valve 14 second gas-liquid separating device 15 gas-side bypass passage resistor 16 to 19 check valve 21 first connection pipe 21*a*, 21*b*, 21*c* first branch pipe 22 second connection pipe 22*a*, 22*b*, 22*c* second branch pipe 23 first bypass pipe 24 second bypass pipe 25 liquid-side outlet pipe gas-side outlet pipe 31 discharge pipe 32 refrigerant pipe 33, 34 short-circuit pipe 35 passage switching circuit 36 suction pipe 37 refrigerant pipe 40 intermediate heat exchanger 41 (41*a*, 41*b*, 41*c*) relay-unit-side refrigerant circuit 42 (42*a*, 42*b*, 42*c*) indoor-unit-side refrigerant circuit 43 pump 100 multi-room air-conditioning apparatus 101 outdoor unit (heat source unit) 102 relay unit 103 (103*a*, 103*b*, 103*c*) indoor unit 104 switching unit 105 second branch portion

The invention claimed is:

1. A multi-room air-conditioning apparatus comprising:

an outdoor unit that includes at least a compressor, a switching valve, and an outdoor-unit-side heat exchanger;

a relay unit that is connected to the outdoor unit by a first connection pipe and a second connection pipe; and a plurality of indoor units, each of which includes an indoor heat exchanger and a first flow control device and which are connected to the relay unit while being arranged in parallel, wherein the outdoor unit includes a first route along which a refrigerant that is discharged from the compressor is guided to the second connection pipe via the switching valve and the outdoor-unit-side heat exchanger, and a second route along which the refrigerant is guided to the second connection pipe via the switching valve while bypassing the outdoor-unit-side heat exchanger, so that the refrigerant is guided in accordance with operation modes including a cooling operation mode, a heating operation mode, a cooling main operation mode, and a heating main operation mode, wherein the relay unit includes a first gas-liquid separating device that is connected to an intervening portion of the second connection pipe, a plurality of switching units that individually connect the indoor units to one of the first connection pipe and the second connection pipe selectively, a first bypass pipe that connects the first gas-liquid separating device to each of the indoor units, a second bypass pipe that connects the first connection pipe to the first bypass pipe, a third flow control device provided to the first bypass pipe, and a second flow control device provided to the second bypass pipe, and wherein the multi-room air-conditioning apparatus further comprises:

a second gas-liquid separating device provided between the outdoor unit and the relay unit and connected to the first connection pipe;

a gas-side outlet pipe that allows a gas refrigerant generated by gas-liquid separation performed by the second gas-liquid separating device to bypass the outdoor-unit-side heat exchanger and to flow into a refrigerant suction port of the compressor; and a liquid-side outlet pipe that alternatively allows, depending on a switching status of the switching valve, the gas refrigerant generated by the gas-liquid separation performed by the second gas-liquid separating device to flow into the refrigerant suction port of the compressor while bypassing the outdoor-unit-side heat exchanger, or bypasses a liquid refrigerant generated by the gas-liquid separation performed by the second gas-liquid separating device to flow into the refrigerant suction port of the compressor via the outdoor-unit-side heat exchanger.

2. The multi-room air-conditioning apparatus of claim 1, wherein, if the switching valve is switched such that the refrigerant discharged from the compressor is guided along the second route, the gas refrigerant generated by the gas-liquid separation performed by the second gas-liquid separating device flows into the refrigerant suction port of the compressor while bypassing the outdoor-unit-side heat exchanger, and the liquid refrigerant generated by the gas-liquid separation performed by the second gas-liquid separating device is supplied to the refrigerant suction port of the compressor via the outdoor-unit-side heat exchanger.

3. The multi-room air-conditioning apparatus of claim 1, wherein, if the switching valve is switched such that the refrigerant discharged from the compressor is guided along the first route, the gas refrigerant that flows into the second gas-liquid separating device is supplied to the refrigerant suction port of the compressor via the gas-side outlet pipe and the liquid-side outlet pipe that are arranged in parallel.

4. The multi-room air-conditioning apparatus of claim 1, wherein the gas-side outlet pipe is provided between an accumulator and the switching valve, and the accumulator is connected to the refrigerant suction port of the compressor.

5. The multi-room air-conditioning apparatus of claim 4, wherein the gas-side outlet pipe is connected in parallel with a passage provided between the outdoor-unit-side heat exchanger and the accumulator or is inserted in the accumulator.

6. The multi-room air-conditioning apparatus of claim 1, wherein the gas-side outlet pipe is connected to a suction side of the compressor.

7. The multi-room air-conditioning apparatus of claim 1, wherein the second gas-liquid separating device is provided in the relay unit.

8. The multi-room air-conditioning apparatus of claim 1, wherein a closed refrigerant circuit that allows the refrigerant to flow through the outdoor unit and the relay unit is provided;

wherein a closed refrigerant circuit that allows another refrigerant that is different from the refrigerant to flow through the indoor units is provided; and wherein an intermediate heat exchanger is interposed between the two refrigerant circuits.

9. The multi-room air-conditioning apparatus of claim 1, wherein the refrigerant comprises a zeotropic refrigerant mixture.

10. The multi-room air-conditioning apparatus of claim 1 further comprising:

a gas flow resistor in the gas-side outlet pipe that lowers the pressure of the gas refrigerant generated by gas-liquid separation performed by the second gas-liquid separating device, such that the gas refrigerant flowing into the refrigerant suction port of the compressor is not saturated.

* * * * *